United States Patent [19]

Chiappetti

[11] 4,261,322

[45] Apr. 14, 1981

[54] VEHICULAR TOLL EJECTING APPARATUS

[76] Inventor: Arthur B. Chiappetti, 10600 S. Oakley, Chicago, Ill. 60643

[21] Appl. No.: 63,900

[22] Filed: Aug. 6, 1979

[51] Int. Cl.[3] ..... F41B 7/00

[52] U.S. Cl. ..... 124/29; 124/34

[58] Field of Search ..... 194/1 E; 124/26, 27, 124/29, 42, 34

[56] References Cited

U.S. PATENT DOCUMENTS

| | | | |
|---|---|---|---|
| 966,288 | 8/1910 | Zenz | 124/42 X |
| 3,191,588 | 6/1965 | Thew | 124/27 |

*Primary Examiner*—Stanley H. Tollberg

[57] ABSTRACT

A toll ejecting apparatus for propelling at least one coin from a vehicle to a toll collection receptacle includes a hollow elongated barrel having a propelling mechanism mounted reciprocatively longitudinally therewithin. The mechanism includes a coin-receiving device having an opening therein for moving the coin longitudinally within the barrel toward the exit end thereof. A mounting device positions the exit end of the barrel to direct it toward the receptacle as the vehicle moves opposite it. A manually-operated device actuates the propelling mechanism to cause it to propel the coin toward the exit end of te barrel.

9 Claims, 5 Drawing Figures

FIG. 1
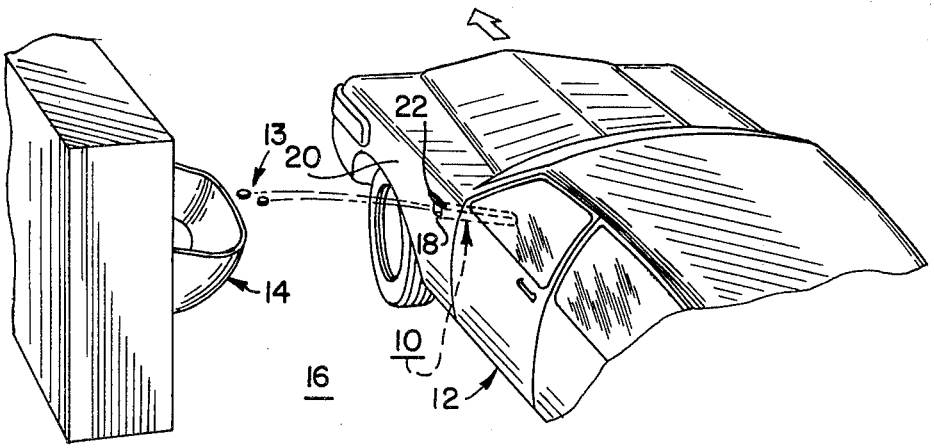
FIG. 2
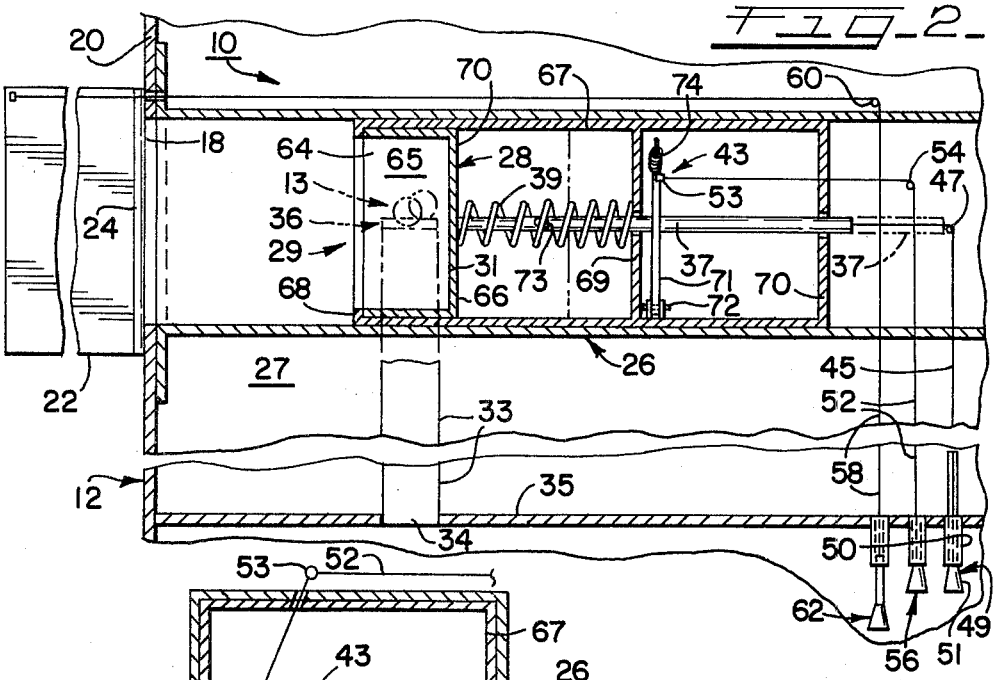
FIG. 3

VEHICULAR TOLL EJECTING APPARATUS

DESCRIPTION

1. Technical Field

The present invention relates in general to a vehicular toll ejecting apparatus, and more particularly relates to apparatus useful for vehicles paying tolls for the use of roadways, bridges, tunnels, and the like.

2. Background Art

Various different types and kinds of systems have been employed for the collection of tolls. For example, applicant's copending patent application Ser. No. 22,679, filed Mar. 22, 1979, discloses a toll collection station which enables a driver of a vehicle to pay the toll while the vehicle is moving past the station without coming to a stop. Such a toll collection station eliminates, or at least greatly minimizes, unwanted and unavoidable delays attendant to the conventional toll collection techniques where the vehicles are required to come to a complete stop adjacent the toll collection station for the purpose of depositing therein coins or other currency for paying the toll. When a vehicle is required to come to a complete stop, the vehicle is no longer being operated at its most efficient speed, and thus fuel is wasted unnecessarily. In the co-pending application, the driver of a vehicle tosses the currency from the moving vehicle into the special toll collection equipment. The size and shape of the toll collection receptacle and the coin counters facilitates such an operation. Such equipment greatly facilitates the collection of tolls to help avoid, or at least to minimize greatly delays attendant to the payment of tolls by a large number of vehicles. It would be highly desirable to have apparatus disposed in the moving vehicles to propel the currency toward the toll collection receptacle, so that the vehicles can travel past the toll collection receptacles at higher rates of speed, since the currency can be propelled relatively accurately in the receptacles.

Thus, it would be highly desirable to have such toll ejection apparatus which would be relatively easy to operate and yet facilitates greatly the transferring of the currency from the vehicle to the stationary collection receptacle.

DISCLOSURE OF INVENTION

Therefore, the principal object of the present invention is to provide a new and improved vehicular toll ejecting apparatus, which facilitates the transferring of currency from a vehicle to a toll collection receptacle.

Briefly, the above and further objects of the present invention are realized by providing a toll ejecting apparatus for propelling at least one coin from a vehicle to a toll collection receptacle. The ejecting apparatus includes a hollow elongated barrel having a propelling mechanism mounted reciprocatively longitudinally therewithin. The mechanism includes a coin-receiving device having an opening therein for moving the coin longitudinally within the barrel toward the exit end thereof. A mounting device positions the exit end of the barrel to direct it toward the receptacle as the vehicle moves opposite it. A manually-operated device actuates the propelling mechanism to cause it to propel the coin toward the exit end of the barrel.

BRIEF DESCRIPTION OF DRAWINGS

The above-mentioned and other objects and features of this invention and the manner of attaining them will become apparent and the invention itself will be best understood by reference to the following description of embodiments of the invention taken in conjunction with the accompanying drawings, wherein:

FIG. 1 is a pictorial view of the vehicular toll ejecting apparatus, which is constructed in accordance with the present invention and which is illustrated mounted in a vehicle moving past a toll collection receptacle;

FIG. 2 is a greatly enlarged, horizontal, cross-sectional view of the apparatus of FIG. 1;

FIG. 3 is a cross-sectional view of the apparatus of FIG. 2;

BEST MODE FOR CARRYING OUT THE INVENTION

Figure 5:
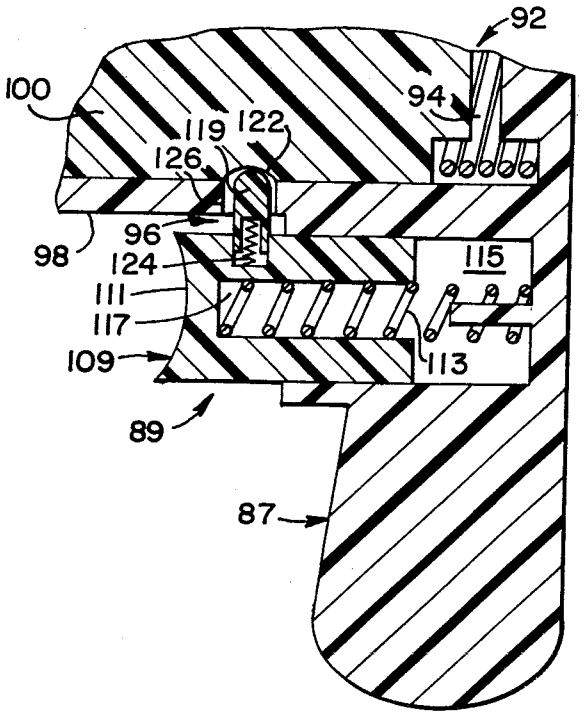
FIG. 5 is a greatly enlarged fragmentary, cross-sectional view of the apparatus of FIG. 4 illustrating it in its set position in preparation of propelling the currency from a vehicle.

Referring now to the drawings, and more particularly to FIGS. 1, 2 and 3 thereof, there is shown a vehicular toll ejecting apparatus 10, which is constructed in accordance with the present invention, and which is mounted within a vehicle, such an automobile 12, for propelling currency, such as the coins 13, toward and into a toll collection receptacle 14 stationed along a roadway 16 as the automobile 12 need not come to a complete stop for payment of the toll. While the apparatus 10 is described in connection with the payment of tolls for a roadway or tollway, it is to be understood that the vehicular toll ejecting apparatus of the present invention may also be used for paying tolls for other purposes, such as the use of bridges, tunnels, parking lots and garages and the like.

The coins 13 are ejected from an opening 18 in the left front fender 20 of the automobile 12 and are propelled into the receptacle 14 of the automobile 12. As best seen in FIG. 1 of the drawings, the ejecting apparatus 10 is inclined slightly from its front downwardly toward its rear to provide the coins 13 with the proper trajectory toward the stationary toll collection receptacle 14 and to retain them within the apparatus 10 prior to releasing them. A cover or closure 22 disposed on the outside of the front left fender 20 is remotely operated to swing to an open position as shown in FIG. 1 for ejecting the coins from the apparatus 10 and is closable to cover over the opening 18 in the fender 20 when the apparatus 10 is not in use. As best seen in FIG. 2 of the drawings, the cover or closure 22 is hingedly connected at 24 to the outside surface of the fender 20.

Considering now the apparatus 10 in greater detail with particular reference to FIG. 2 of the drawings, the apparatus 10 includes an elongated outer tubular housing 26 mounted at least partially within the engine compartment 27 and having an open-ended reciprocatively mounted coin receptacle 28 forming a part of a coin propelling mechanism 29. The coin receptacle 28 includes an upper opening 31 for receiving the coins 13 prior to their ejection by means of an inclined coin chute 33 extending at its upper entrance end 34 through the dashboard 35. In this manner, the user merely slips the coins into the entrance end 34 to load them into the coin receptacle 28 by falling under the force of gravity through the chute 33 and dropping therefrom via the lower exit end 36 of the chute 33 into the receptacle 28. The housing 26 serves to mount the apparatus 10 in the slightly inclined manner to provide the proper trajectory for the coins 13.

A longitudinally extending reciprocatively mounted rod 37 extends axially within the tubular housing 26 and is adapted to be retracted rearwardly from its solid line position to its phantom line position as shown in FIG. 2 of the drawings, against the force of a compression spring 39 until a latch, generally indicated at 43, secures releasably the rod 37 in its retracted position against the force of the compression spring 39, as hereinafter described in greater detail.

In order to control remotely the apparatus 10 from the interior of the vehicle 10, line 45 is attached to and extends from the rear end of the rod 37 over a capstan 47 to a slidably movable handle 49 mounted at the inside of the dashboard 35 so that the rod 37 can be retracted remotely by the driver of the vehicle against the force of the compression spring 39. The rod 37 is held releasably in its retracted position by the latch 43, which engages automatically as hereinafter described in greater detail. The handle 49 is slidably mounted telescopically within a sleeve 50 and has a knob 51 at the end thereof. For the purpose of releasing the latch 43, a line 52 is connected at one of its ends to the latch 43 for remotely controlling its operation and extends over a pair of spaced-apart capstans 53 and 54 to a slidably mounted handle 56 at the inner side of the dashboard 35 disposed adjacent and being similar to the handle 49. In this regard, when the handle 56 is pulled outwardly away from the dashboard 35, the handle 56 pulls the line 52 which in turn releases the latch 43 for the coin propelling mechanism 29, which in turn permits the rod 37 to snap forwardly for propelling the coins 13 from the coin receptacle 28 through the opening 18 in the fender 20 toward and into the toll collection receptacle (not shown). When the handle 62 is pulled away from the dashboard 35, the line 58 pulls on the cover 22 to swing it outwardly and upwardly to its open position as shown in FIGS. 1 and 2 of the drawings. In order to hold the cover 22 in its open position, a detent (not shown) in the handle 62 holds the line 58 retracted. In order to close the cover 22, the handle 62 is pushed forcibly inwardly toward the dashboard 35 to release the detent and thus cause the cover 22 to swing downwardly into a vertical disposition against the outer fedner surface over the opening 18.

Considering now the coin receptacle 28 in greater detail, the coin receptacle 28 has a front opening 64 which is aligned with the opening 18 in the fender 20. The receptacle 28 is generally in the shape of a hollow block having a bottom wall 65 for receiving the coins 13. Since the housing 26 is inclined downwardly and rearwardly, the coins are held by gravity against the rear wall 66.

The tubular housing 26 is generally rectangular in cross section and has fixed to it an inner complementary shaped elongated tubular housing 67 having an inturned front flange 68 to serve as a stop member for the coin receptacle 28 to terminate its forward motion and has an apertured interior wall 69 for supporting slidably the rod 37, which extends rearwardly beyond an apertured end wall 70. The spring 39 extends between the coin receptacle 28 and the inner wall 69.

Considering now the latch 43 in greater detail with particular reference to FIG. 3 of the drawings, the latch 43 includes a lever 71 which is pivotally connected at one of its ends at 72 to the elongated inner housing 67 to swing into a notch or opening 73 in the rod 37 to secure it in its retracted position as shown in FIG. 3 of the drawings. A bias spring 74 is stretched between the lever 71 and the inner housing 67 to bias the lever 71 against the rod 37.

In operation, when the automobile 12 approaches the receptacle 14, the driver of the vehicle prepares to pay the toll by first pulling the handle 62 away from the dashboard 35 to a position as shown in FIG. 2 of the drawings to cause the line 58 to pull the cover 22 to its open position, as shown in FIGS. 1 and 2 of the drawings. The coins 13 are then slipped into the entrance end 34 of the coin chute 33 to guide them as they fall into the coin receptacle to cause them to be positioned on the bottom wall 65.

The handle 49 is then pulled outwardly to retract the rod 37 against the force of the spring 39 until the lever 71 is urged into the notch 73 by the bias spring 74. At this point, the coins are prepared to be ejected from the apparatus 10.

When the automobile 12 moves opposite the receptacle 14, the handle 56 is pulled outwardly. In this manner, the handle 56 pulls on the line 52 which, in turn, pulls the lever 71 out of the notch 73 by causing the lever 71 to pivot about its pivot point 72 in a clockwise direction as viewed in FIG. 3 of the drawings until the rod 37 becomes free to snap forwardly under the force of the return spring 39, which propels the rod 37 and the coin receptacle 28 forwardly until it engages the flange 68, thereby ejecting the coins 13 toward and into the toll collection receptacle 14 as the automobile moves therepast. When the rod 37 snaps forwardly, it pulls on the line 45 to return the handle 49 to its retracted position as shown in FIG. 2 of the drawings. It should be noted that the bias spring 74 serves to return the line 52 and thus the handle 56 to its initial position. It should also be understood that the handle 56 is designed to permit the line 52 to be pulled forwardly slightly when the lever 71 drops into the notch 73 during the setting of the latch 43.

The operation is completed by pushing forcibly the handle 62 from the position shown in FIG. 2 of the drawings to release the detent (not shown), whereby the cover 22 can swing downwardly under the force of gravity from its open position as illustrated in the drawings to a closed position over the opening 18 in the fender 20. Thereafter, the operation may be repeated as desired.

Figure 4:
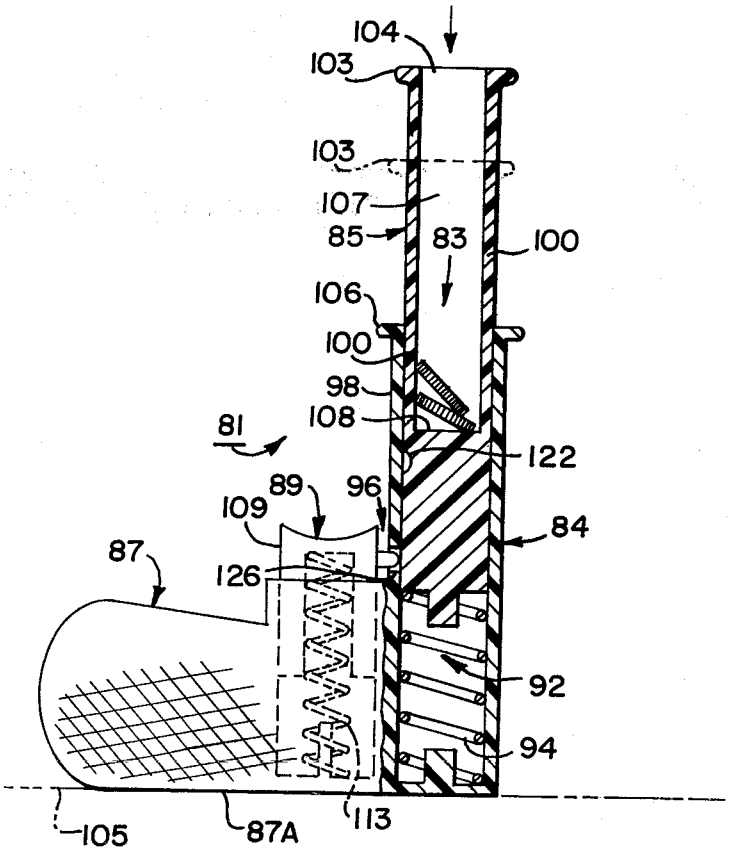
FIG. 4 is a cross-sectional, elevational view of another vehicular toll ejecting apparatus, which is constructed in accordance with the present invention.

Referring to FIGS. 4 and 5 of the drawings, there is shown a hand-held vehicular toll ejecting apparatus 81, which is also constructed in accordance with the present invention, and which is adapted to propel from a moving vehicle, such as the automobile 12 of FIG. 1, the coins 83 disposed in the apparatus 81 to a toll collection receptacle (not shown), which may be similar to the receptacle 14 of FIG. 1. The apparatus 81 generally comprises an L-shaped body 84 having a telescopically retractable two-piece barrel 85 and extending at right angles thereto a knurled handle 87. A trigger 87 is mounted in the handle 87 for actuating a coin propelling mechanism generally indicated at 92. The coin propelling mechanism 92 includes a spring 94 for serving to propel the coins 83 forwardly out of the end of the barrel 85 as hereinafter described in greater detail. A latch, generally indicated at 96, carried by the trigger 87, maintains the barrel 85 in its retracted position against the force of the spring 94 until the trigger 89 is pulled by the fingers of the user toward the handle 87 as hereinafter described in greater detail. A latch, generally indicated at 96, carried by the trigger 87, maintains the barrel 85 in its retracted position against the force of the spring 94 until the trigger 89 is pulled by the fingers of the user toward the handle 87 as hereinafter described in greater detail.

Considering now the barrel 85 in greater detail, the barrel 85 includes an outer stationary tube 98 which is integral with the handle 87 and has disposed telescopically therein a movable tube 100 which is axially aligned therewith and projects forwardly therefrom. A peripheral flange 103 at an open exit end 104 of the movable tube 100 is engageable by the hand of the user to push the movable tube 100 axially and telescopically within the outer stationary tube 98 to a retracted position as indicated in solid lines in FIG. 5 of the drawings and to a position indicated in phantom lines in FIG. 4. In this regard, the user can load the apparatus 81 with one hand by dropping the coins 83 into the open exit end 104 of the movable tube 98, and then press downwardly with the palm of the hand at the flange 103 while positioning a flat portion 87A at the rear surface of the handle 87 against a convenient flat surface, such as a portion of the seat 105 next to the driver.

The apparatus 81 is used to propel the coins 83 out of an open window to deposit them in a toll collection receptacle (not shown) as the automobile moves therepast. In so doing, the forward portion of the movable tube 100 projecting outwardly beyond the end portion of the stationary tube 98 at a peripheral flange 106 can be rested upon the automobile window frame (not shown) between the flanges 103 and 106. Thus, the forward portion of the movable tube 100 and the flanges 103 and 106 serve as mounting means to help orient the apparatus 81 with the barrel 85 inclined slightly rearwardly as it is pointed out of the open window.

A coin-receiving passage 107 in the movable tube 100 enables the coins 83 to enter it and to rest in a bottom or back wall 108 therein. When the apparatus 81 is disposed in its position for ejecting the coins therefrom, it is tilted slightly rearwardly and downwardly to maintain the coins 83 in their loaded position within the movable tube 100.

Considering now the latch 96 in greater detail, the latch includes a finger member 109, which includes a finger engageable arcuate surface 111 which may be grasped by the fingers of the user to squeeze it toward the handle 87. A bias spring 113 urges resiliently the finger member 109 outwardly from the handle 87 and is disposed within an opening 115 of the handle 87. An opening 117 in the trigger member 109 receives the opposite end of the spring 113. The latch 96 includes a latching member 119 extends upwardly out of the finger member 109 and is reciprocatively slidably mounted on the finger member 109 to extend into a curved notch or opening 122 in the movable tube 100 for latching it in position. A bias spring 124 urges resiliently the latching member 119 through an opening 126 in the rear end portion of the outer tube 98 and into engagement with the curved notch 122 at the rear end of the movable tube 100.

In operation, in order to eject the coins 83 from the apparatus 81, the hand-held apparatus 81 is positioned by the user in a generally vertical disposition as shown in FIG. 4 of the drawings, and the coins 83 are dropped through the open exit end 104 and into the movable tube 100 into the position as shown in FIG. 4 of the drawings at the bottom internal wall 108. While holding the apparatus 81 in a generally vertical disposition with the flat surface 89A pressed against the seat 105 or other convenient surface, the hand of the user presses downwardly on the movable tube 100 at the peripheral flange 103 surrounding the open exit end 104 to move the tube 100 axially downwardly to retract it within the outer stationary tube 98 against the force of the spring 92. The inner movable tube 100 moves axially until the notch 122 moves opposite the opening 126 to permit the latching member 119 of the latch 96 to be urged into the notch 122 by means of the bias spring 124 at best seen in FIG. 5 of the drawings.

When the vehicle moves near the toll collection receptacle (not shown), the driver of the vehicle opens the window (not shown) adjacent the driver's seat and holds the apparatus 81 by the handle 87 in a generally horizontal disposition with the exit end 104 disposed out of the open window and with the end portion of the movable tube 100 resting on the window frame (not shown) between the flanges 103 and 106 for supporting the apparatus 81. The barrel 85 of the apparatus 81 is held in a slightly inclined rearwardly position to insure that the coins 83 remain the movable tube 100 until ejected therefrom. When the vehicle moves opposite the toll collection receptacle, the user pulls the trigger 89 to retract it against the force of the spring 113 into the opening 115 of the handle 87. In so doing, the member 119 is cammed out of the opening 122 to enable the movable tube 100 to be released from the stationary tube 98, whereby the spring 92 causes the movable tube 100 to snap axially outwardly relative to the stationary tube 98. As a result, the coins 83 are propelled out of the exit end 104 of the movable tube toward the toll collection receptacle (not shown). Therefore, in a similar manner as the apparatus 10 of FIG. 1, the coins can be propelled in a relatively accurate manner at a high rate of speed and at a proper trajectory toward and into the receptacle as the vehicle moves at a reasonable rate of speed therepast.

While particular embodiments of the present invention have been disclosed, it is to be understood that various different modifications are possible and are contemplated within the true spirit and scope of the appended claims. For example, as indicated in the drawings, most of the parts of the apparatus 10 are composed of suitable metal material and most of the parts of the manual apparatus 81 are composed of lightweight plastic material. Other types and kinds of materials may be employed by those skilled in the art. There is no intention, therefore, of limitations to the exact abstract or disclosure herein presented.

I claim:

1. Ejecting apparatus for propelling at least one coin from a vehicle into a toll collection receptacle comprising: hollow elongated barrel means having an open end for guiding the coin in its path of travel toward the receptacle; propelling mechanism mounted reciprocatively longitudinally within said barrel means, said mechanism including coin-receiving means having an opening therein for moving the coin longitudinally within said barrel means toward the exit end thereof; mounting means for positioning the exit end of said barrel means toward the receptacle as the vehicle moves opposite it; and manually-operated means for actuating said propelling mechanism to cause it to propel the coin toward the exit end of said barrel means, wherein said barrel means having an opening therein opposite said coin-receiving means, said coin-receiving means including a hollow block, said opening in said coin-receiving means being disposed opposite said opening in said barrel means.

2. Ejecting apparatus according to claim 1, wherein said opening in said block is disposed in the top surface thereon and opens outwardly at the front portion thereof.

3. Ejecting apparatus according to claim 1, further including means for controlling remotely the setting and releasing of said latching means from the interior of the vehicle.

4. Ejecting apparatus according to claim 1, wherein said apparatus is generally L-shaped having a handle disposed at right angles to said barrel means, said manually-operated means being a trigger carrying latch.

5. Ejecting apparatus according to claim 2, when said propelling mechanism includes a rod fixedly connected to said block and extending axially within said barrel means, spring means for urging resiliently said block toward said open exit end of said barrel means, said latching means securing releasably said rod and said block in a retracted coin-receiving position.

6. Ejecting apparatus according to claim 5, when said propelling mechanism includes a rod fixedly connected to said block and extending axially within said barrel means, spring means for urging resiliently said block toward said open exit end of said barrel means, said latching means securing releasably said rod and said block in a retracted coin-receiving position.

7. Ejecting apparatus according to claim 6, further includes a remotely controlled cover movably mounted on the vehicle over the opening therein.

8. Ejecting apparatus according to claim 7, wherein said latching means includes a pivotally mounted lever spring biased against said rod, said rod having a notch in it for receiving said lever.

9. Ejecting apparatus according to claim 4, wherein said propelling mechanism includes a stationary member fixed to the handle and a movable member mounted on the stationary member and movable longitudinally relative thereto said movable member carrying said coin-receiving means, spring means for urging resiliently said movable member forwardly, said mounting means being a forward portion of said movable member and including a pair of peripheral flanges at the respective end portions of the movable and stationary members, said latch retaining releasably the movable member in its retracted position, said latch including a finger having a cam surface therein for engaging a curved opening in said movable member.

* * * * *